US008387678B1

(12) United States Patent
Park et al.

(10) Patent No.: US 8,387,678 B1
(45) Date of Patent: Mar. 5, 2013

(54) SENSOR AIDED DIRECT GATING FOR METAL CASTING

(75) Inventors: Junyoung Park, Greer, SC (US); Jason Robert Parolini, Greer, SC (US); Jon Conrad Schaeffer, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/300,099

(22) Filed: Nov. 18, 2011

(51) Int. Cl.
*B22D 35/04* (2006.01)
*B22D 37/00* (2006.01)

(52) U.S. Cl. ..... 164/133; 164/135; 164/335; 164/155.2

(58) Field of Classification Search ..... 164/133–136, 164/335, 337, 457, 151.3, 155.1, 155.2
See application file for complete search history.

(56) References Cited

U.S. PATENT DOCUMENTS

| | | | | |
|---|---|---|---|---|
| 3,511,471 | A | 5/1970 | Rossi | |
| 3,917,132 | A | 11/1975 | Beijen | |
| 4,576,217 | A * | 3/1986 | Shaw | 164/130 |
| 5,965,052 | A | 10/1999 | Sato et al. | |
| 6,244,328 | B1 * | 6/2001 | Grolla | 164/359 |
| 7,140,415 | B1 | 11/2006 | Wilson et al. | |

FOREIGN PATENT DOCUMENTS

| | | | |
|---|---|---|---|
| JP | 57-25276 | * | 2/1982 |
| JP | 64-34576 | * | 2/1989 |

* cited by examiner

*Primary Examiner* — Kevin P Kerns
(74) *Attorney, Agent, or Firm* — McNees Wallace & Nurick LLC

(57) ABSTRACT

A mold system and method for producing a casting. The mold system utilizes multiple channels, each channel comprising a sprue and gating system, to feed the mold cavity at different heights. When a lower portion of the mold is filled, a controller is signaled to initiate filling of the mold through a second channel positioned above the lower portion. This mold system desirably provides the hottest molten metal to the last portion of the casting to freeze with or without the use of risers, eliminating casting defects. The system also enables the controlled pouring of dissimilar metal castings.

21 Claims, 8 Drawing Sheets

SENSOR AIDED DIRECT GATING FOR METAL CASTING

FIELD OF THE INVENTION

The present invention is directed to molds for metal casting, and specifically for efficiently delivering molten metal to regions of a casting where shrinkage is expected.

BACKGROUND OF THE INVENTION

Casting defects frequently arise in complex castings as a result of shrinkage in the last regions of the casting to solidify. Ideally, in casting design, sections most distant from available liquid metal will solidify first, and liquid metal will be available to feed the solidifying metal to prevent shrinkage. This solidification process, in an ideal casting, continues until the heaviest and last-to-freeze section is reached.

Castings are not always ideal, and the heaviest section, if there is one, may not always be the last section to freeze. To deal with this, mold designers include risers, which provide reservoirs of molten metal to feed hot molten metal to the casting as it solidifies. The primary function of the riser is to feed molten metal to the casting as it solidifies. Thus, a properly designed riser should be the last portion of the mold system to freeze. Of course, riser metal does not contribute to metal yield, as it must be cut from the casting, even though it may be remelted.

Castings, including risers, are fed by gating systems that feed molten metal from the metal source, usually a furnace or pouring ladle into the mold. Molten metal enters the mold cavity through gating systems which usually are designed to avoid turbulent flow. Gating systems may be top gating systems, bottom gating systems, side gating systems and step gating systems. The latter permit molten metal to enter the mold cavity successively from bottom to top as the mold is filled.

Any mold system that reduces the size of risers or completely eliminates the use of risers while simultaneously providing sufficient molten metal to feed shrinkage during solidification may improve metal yield, making the process more efficient and cost-effective. Other advantages also may accrue from such a system.

SUMMARY OF THE INVENTION

A mold system is set forth wherein the mold system includes a first sprue and a second sprue and a pouring basin arrangement for selectively feeding molten metal to the first sprue and the second sprue. The mold includes a mold cavity. A first gating system having a feed or opening, into the mold cavity provides fluid communication between the first sprue and a first portion of the mold cavity. A second gating system having a feed, or opening, into the mold cavity provides fluid communication between the second sprue and a second portion of the mold cavity. The feed of the second gating system supplies the mold cavity with fluid above the feed for the first gating system. The mold system may include a first stopper that is associated with the first sprue to regulate fluid flow through the first sprue. The fluid is molten metal. The mold system may further include a second stopper associated with the second sprue regulates molten metal flow through the second sprue. A sensor in the mold determines the level of the molten metal within the mold cavity. Whether the stoppers are required depends on the pouring basin arrangement. When separate pouring basins are used to supply molten metal to the first and second sprue, or when the pouring basin includes a divider that segregates metal flow to the first sprue and the second sprue, the stoppers may not be required. The sensor may be associated with the feed, or opening, in the second gating system so that molten metal flow through the second gating system can be initiated when the molten metal reaches a predetermined level in the mold cavity. The mold system also includes a controller in communication with the sensor. When the sensor senses that molten metal is at the first predetermined level indicating that the first portion of the mold cavity is filled with molten metal, which is communicated to the controller, the controller responds by restricting the flow of molten metal through the first sprue and activates a flow of molten metal through the second sprue to allow molten metal to fill the second portion of the mold cavity. The controller may accomplish this by controlling the pouring of molten metal into the pouring cup from the pouring ladle or by restricting the flow of molten metal in the pouring cup into the sprues.

Also set forth is a method for producing a casting comprising the steps of providing a mold system wherein the mold having a pouring basin with a first sprue and a second sprue. The mold includes a mold cavity, a first gating system having a feed, or opening, that provides fluid communication between the first sprue and a first portion of the mold cavity and a second gating system having a feed that provides fluid communication between the second sprue and a second portion of the mold cavity. The feed or opening of the second gating system feeds the mold cavity above the feed for the first gating system. The mold system also includes a first stopper associated with the first sprue that regulates fluid flow through the first sprue and a second stopper associated with the second sprue that regulates fluid flow through the second sprue. A sensor associated with the feed in the second gating system determines the fluid level within the mold cavity. The mold system also includes a controller in communication with the sensor. Molten metal is provided and poured into the pouring basin or pouring cup. The first stopper is removed from the first sprue so that the molten metal flows through the first gating system into the mold cavity. The level of molten metal in the cavity is monitored so that the sensor can determine when the molten metal is at a predetermined first level within the mold. When the level of molten metal in the mold reaches the predetermined level, that level is communicated to the controller by a means suitable by the sensor. When the controller receives the determination that the molten metal within the mold is at a predetermined first level, the controller acts to restrict the flow of metal into the first sprue by inserting the first stopper into the first sprue. The controller also withdraws the second stopper from the second sprue to permit the flow of molten metal into the second sprue, allowing hot molten metal from the pouring cup to flow through the second gating system and into the second portion of the mold cavity.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
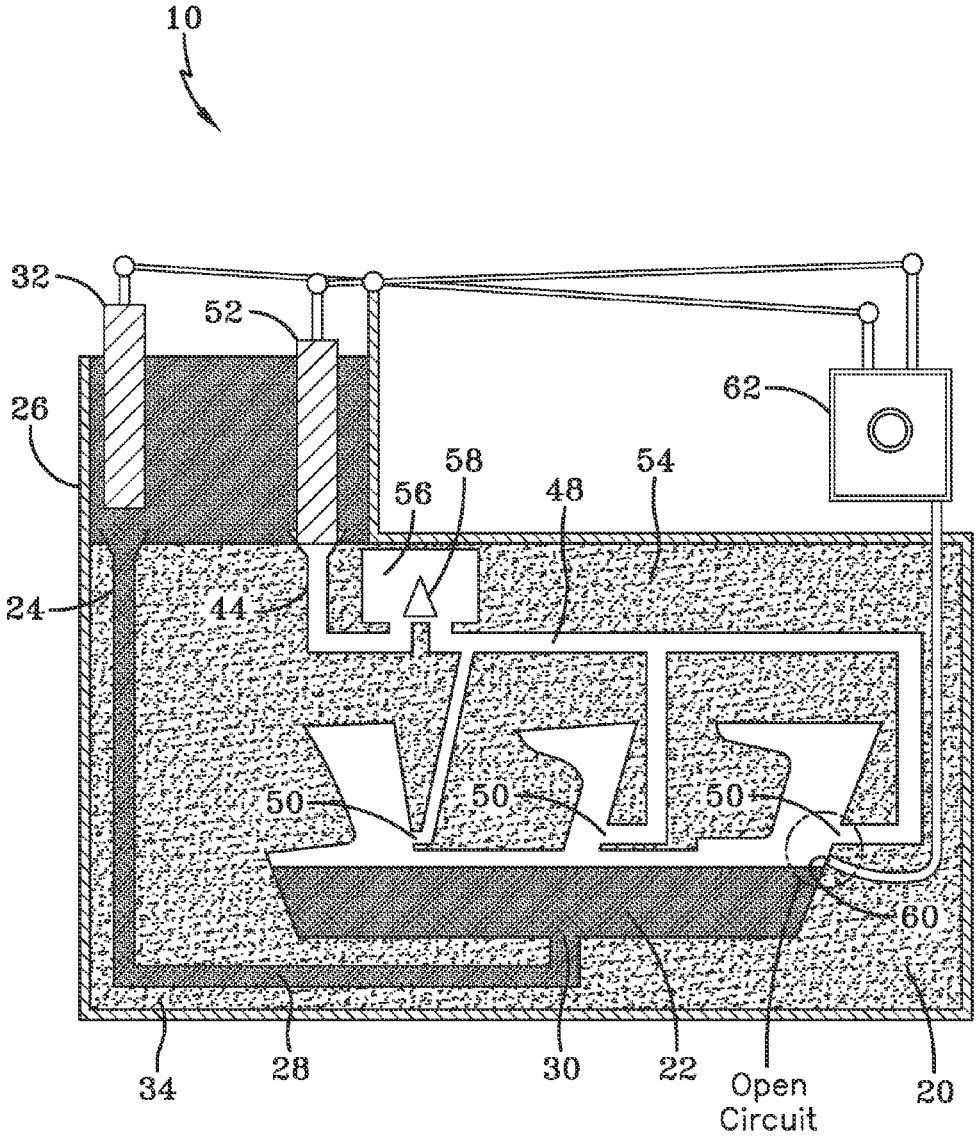
FIG. 1 is a cross-sectional view of a first embodiment of the multiple circuit mold system of the present invention with a lower portion of the mold cavity being filled with molten metal.

A mold system is set forth that reduces the size of risers or completely eliminates the use of risers. The system provides sufficient molten metal to feed shrinkage during solidification, and it provides hot molten metal to those areas. This is particularly beneficial for parts having a significant change in section thickness in which the article transitions from a thick section part to a thin section part. One such exemplary part is a turbine casing or compressor casing, wherein the section thicknesses transition markedly in a very short distance. The ability of the mold system to feed the thinner sections of the mold with hot, molten metal from a second sprue system after a thicker section has been filled should eliminate many of the common defects associated with shrinkage. It should also reduce defects such as cold shuts and misruns as hot metal from the second sprue system fills any shrinkage that may arise as the thicker section solidifies. Reducing such defects will improve yield. The mold system improves efficiency and cost effectiveness as scrapped components are reduced, and yield, resulting from reduced riser metal is increased.

This mold system also may provide the ability to perform dissimilar metal casting. This mold system enables a first portion of a mold to be filled with a first metal, and a second portion of a mold to be filled sequentially with a second metal. As used herein, dissimilar metals refer to two or more metals, each having a different melting/solidification temperature. Thus, dissimilar metals refers not only to different categories of metals, such as steels, cast irons or nickel-based superalloys, but also dissimilar metals may include for example, two different cast irons, two different steels, two different nickel-based alloys, where the melting/solidification temperature varies because of compositional differences. Thus, an article may be cast with two different alloys, each of the alloys having different properties, the properties being determined by the service conditions experienced at different locations of the article. Once again, a turbine casing is illustrative. The thicker section(s) may be cast from a first alloy having properties selected for conditions experienced by the thicker section(s) while the thinner section may be cast from a second alloy having properties selected for conditions experienced by the thinner section, when appropriate. For example, the first alloy may be maximized with wear resistance and high tensile strength. The second alloy may be maximized for creep resistance, high temperature corrosion resistance and low cycle fatigue resistance. The mold set forth herein permits casting of an article using alloys cast into different portions of the mold, wherein the alloys have properties maximized for their performance in different portions of the article.

The mold system provides multiple circuits to feed the mold cavity. As used herein, each circuit includes a sprue, a stopper for controlling the flow of molten metal into the sprue, a gating system and a feed, or opening, from the gating system. The feed allows for the flow of molten metal from the gating system into the mold cavity. The mold system also provides a sensor for sensing liquid level within the mold. The sensor is in communication with a controller, which also controls the positioning of the stopper in the sprue in each circuit.

Referring now to FIG. 1, a first embodiment of mold system 10 is set forth. In this embodiment, the article that is cast is a complex item such as a turbine or compressor casing, wherein the thinner sections of the casing are positioned in the top portion of the mold and the thicker sections of the casing are positioned in the bottom portion of the mold. However, the mold system of the present invention is suitable for other structural applications, including but not limited to a compressor discharge case. The mold system of the present invention is usable not only for many turbine alloys, such as cast steel, cast iron, cast superalloy, and titanium alloys, but also for any alloy that is usable in cast form. Mold system 10 includes a mold 20 having a mold cavity 22. A first sprue 24 extends from a pouring basin or pouring cup 26. First sprue 24 provides fluid communication between pouring cup 26 and first gating system 28. First gating system provides fluid communication between first sprue 24 and mold cavity 22 through first feed or opening 30. A first stopper 32 movable in relation to first sprue controls the flow of fluid, which typically is molten metal in a casting operation, from pouring cup through first circuit 34, which includes first stopper 32, first sprue 24, first gating system 28 and first feed, into mold cavity 22.

Mold system 10 includes a second circuit 54 which comprises a second stopper 52, a second sprue 44, a second gating system 48 and a second feed 50. Second circuit 54 operates in a manner similar to first circuit 34. Second stopper 52 regulates the flow of molten metal from pouring basin 26 into second sprue 44, which is in fluid communication with mold cavity 22 through second gating system 48 through second feed 50.

Mold system 10 further includes a sensor 60 positioned adjacent to mold cavity 22. Sensor 60 is in communication with controller 62, which in turn controls the operation of first and second stoppers 31, 52 respectively. Mold system 10 of FIG. 1 also depicts a riser 56 and optional mold inoculants, which, while not essential to the concept of mold system 10, may be necessary depending upon the metal alloy, the size of the casting as well as the complexity of the casting being poured.

Sensor 60 monitors the level of molten metal in mold cavity 22. When the level of molten metal in mold cavity reaches a predetermined level, sensor communicates to controller 62 that the predetermined level has been reached. Sensor 60 may range from an unsophisticated, one use device to a very sophisticated electronic device. Similarly, controller 62 may be a simple device or a sophisticated electronic controller or computer controller that also controls other aspects of foundry operations. For example, sensor 60 may be as simple as a metal specimen having a melting temperature range lower than the melting temperature range of the molten metal being poured, the metal specimen being placed at a predetermined height within mold cavity 22. For example, copper having a melting point of 1356° K (1981° F.) acts as an excellent sensor for cast irons, steels and superalloys, while lead having a melting point of 600° K (620° F.) is an effective sensor for copper and its alloys. The metal plug may be connected to a controller which may be a simple spring system. The metal plug may bias a spring downward, the spring being connected to first stopper 32 and second stopper 52. The spring and stoppers are balanced so that when the spring is biased downward first stopper 32 is withdrawn from first sprue 24 while second stopper 52 blocks second sprue 44. As molten metal flows into mold cavity 22, the mold cavity is filled until it reaches a predetermined height. Sensor 60 is located at the predetermined height and melts as the molten metal contacts it, releasing the downward bias of the spring, which causes first stopper 32 to block the entrance to first sprue 24, while second stopper 52 is urged upward so that molten metal may flow into second sprue 44, the molten metal flowing into mold cavity 22 through second circuit 54.

Sensor 60 and controller 62 may be more complex. Sensor 60 may be a thermistor or thermocouple that may be placed in mold 20 or which may be positioned to be in the mold cavity 22, and controller may be a computer or other electronic device in communication with the thermistor or thermocouple. The thermistor or thermocouple monitors the temperature of mold 20 or mold cavity 22. As the temperature in the mold 20 or mold cavity 22 increases, which is inherent as the mold cavity is filled with molten metal; a signal indicative of the temperature is signaled to the controller. When the temperature reaches a predetermined temperature, the controller may signal first stopper 32 to shut the flow of molten metal to first sprue 24 (i.e. first stopper blocks first sprue) and second stopper 52 to initiate the flow of molten metal to second sprue 44 (i.e. second stopper moves to open second sprue). This may be accomplished by any convenient means. For example, first stopper 32 and second stopper 52 may each be connected to solenoid motors, the motors being in communication with controller 62 and operating in response to signals from controller 62.

Sensor 60 may be an even more sophisticated device, such as a device that monitors sound to determine the molten metal level in the mold cavity as it is filled and communicates the information to controller 62. Thus it should be apparent to one skilled in the art that sensor 60 may be any device that measures the level of molten metal in mold cavity 22 and communicates to controller 62 when the level of molten metal reaches a predetermined level. Controller 62 may be any device that can receive information regarding the level of molten metal in mold cavity 22 and when the molten metal has reached a predetermined level and direct the movement of stoppers 32, 52 in response to molten metal reaching a predetermined level.

Stoppers 32, 52 may be any high temperature material that will not react with molten metal. For example, stoppers may be a high temperature ceramic rod or tube movable from a first position in which the corresponding sprue is open to accept the flow of molten metal to a second position in which the corresponding sprue is closed to stop the flow of molten metal. Although shown as a rod, stoppers may be discs, ceramic or CMC disks that engage sprues by moving to open or block the sprues. For molten metals having a relatively low melting temperature range such as copper and its alloys, stoppers may be comprised of a higher melting temperature range alloy such as steel.

Referring again to FIG. 1, first stopper 32 is depicted out of engagement with first sprue 24, allowing molten metal to flow through first circuit 34 to partially fill mold cavity 22. In FIG. 1, the predetermined metal level is set to be at the height of sensor 60, and the molten metal in mold cavity 22 is just below sensor 60. The predetermined metal level is always above first feed 30, and may be below, at or slightly above second feed 50.

Figure 2:
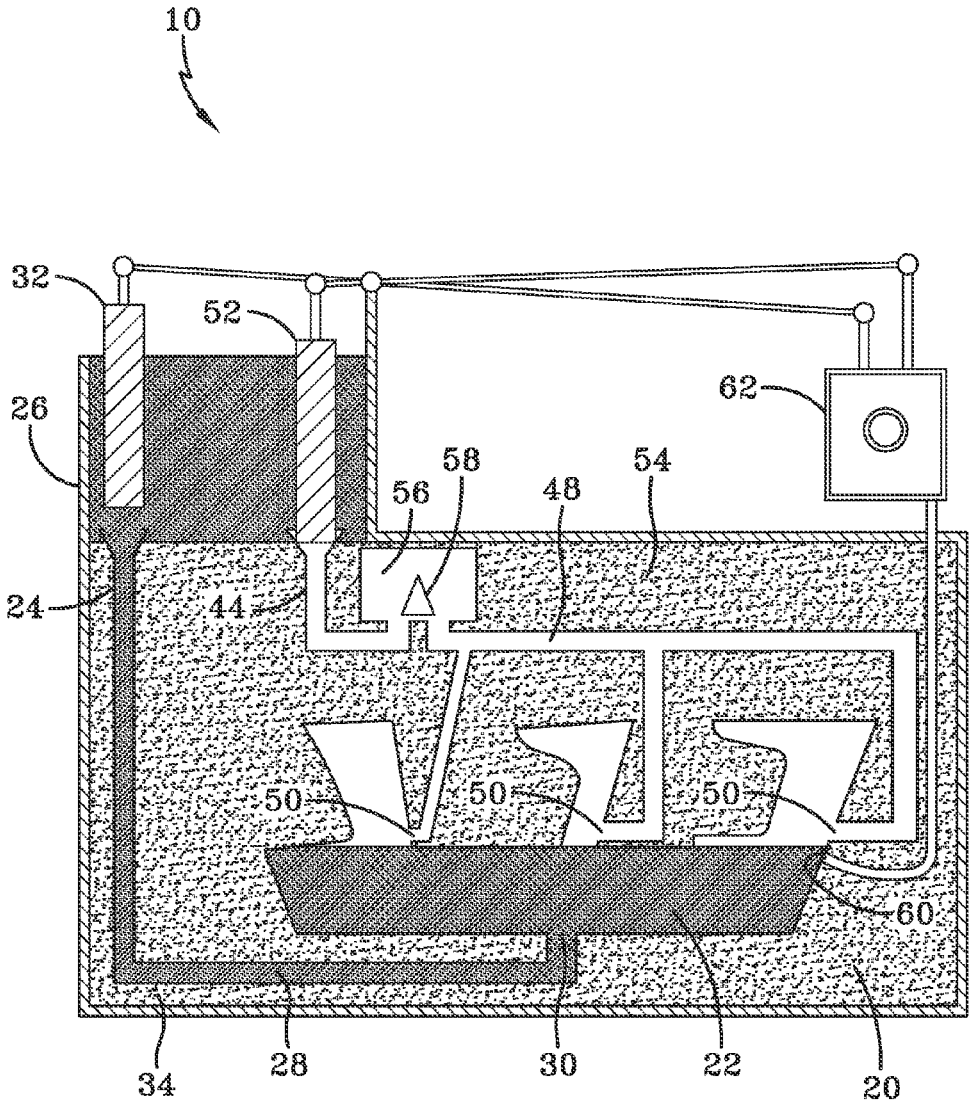
FIG. 2 is a view of FIG. 1 with the molten metal filling the mold cavity to a predetermined level at which the sensor is located.

Referring now to FIG. 2, molten metal has just reached the predetermined level in mold cavity 22, which is where sensor 60 is positioned. In FIG. 2, controller 62 has not yet caused first stopper 32 to block the flow of molten metal into first circuit 34 and second stopper 52 to initiate the flow of molten metal through second circuit 54. The method that sensor 60 uses to communicate the molten liquid level to controller 62, and that controller 62 utilizes to activate/deactivate stoppers will depend on the sophistication of sensor 60 and controller 62 as discussed previously.

Figure 3:
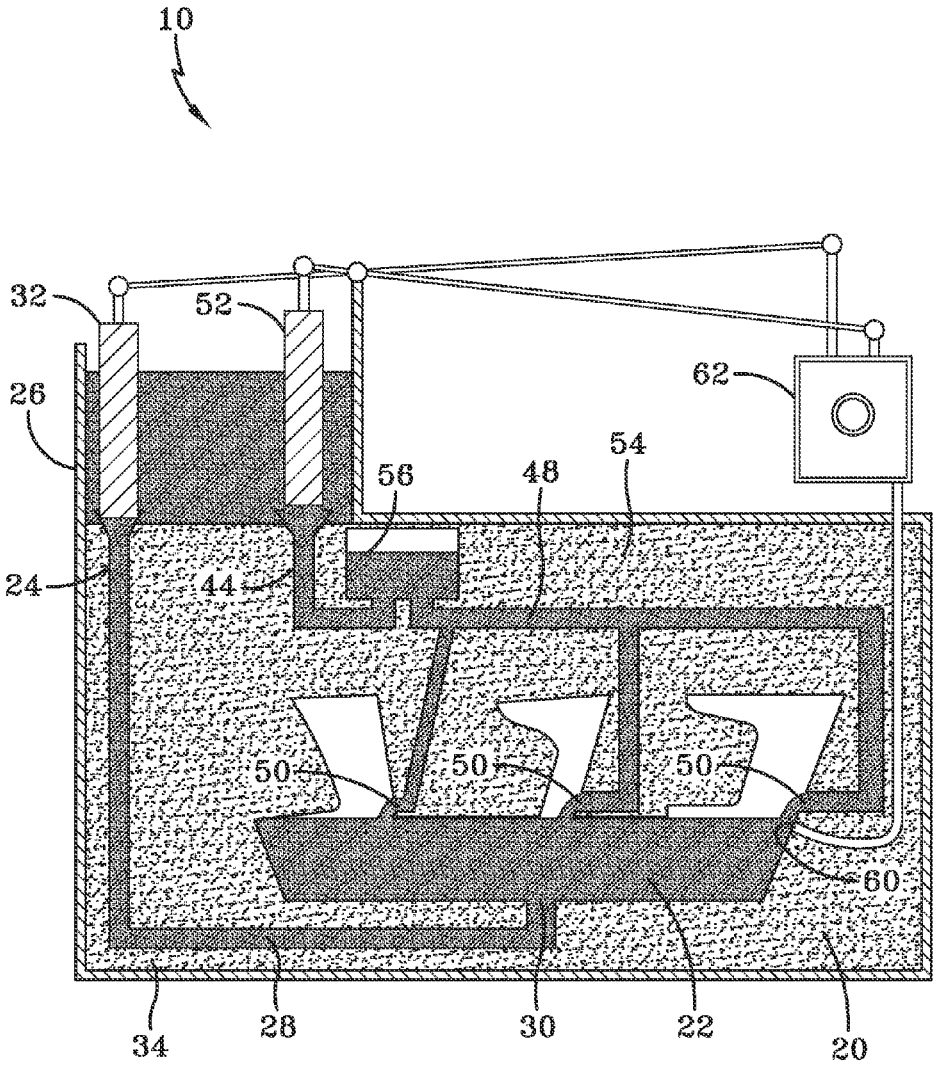
FIG. 3 is a view of FIG. 1 with molten metal continuing to fill the mold cavity through the second circuit after the first circuit has been shut down or inactivated.

Referring now to FIG. 3, which depicts mold cavity 22 shortly after controller causes first stopper 32 to block first sprue 24, thereby stopping flow of molten metal into first circuit 34, and second stopper 52 unblocks second sprue 44, allowing molten metal to enter the top half of mold cavity 22 through second circuit 54. As molten metal flows through second circuit 54, hot metal enters the thin section through one of a plurality of second feeds 50. Hot metal flows over the necessarily cooler metal in the lower section of the mold cavity, supplying hot molten metal over the cooler molten metal, mixing with it, as well as supplying hot molten metal to any shrinkage that may have developed.

Figure 4:
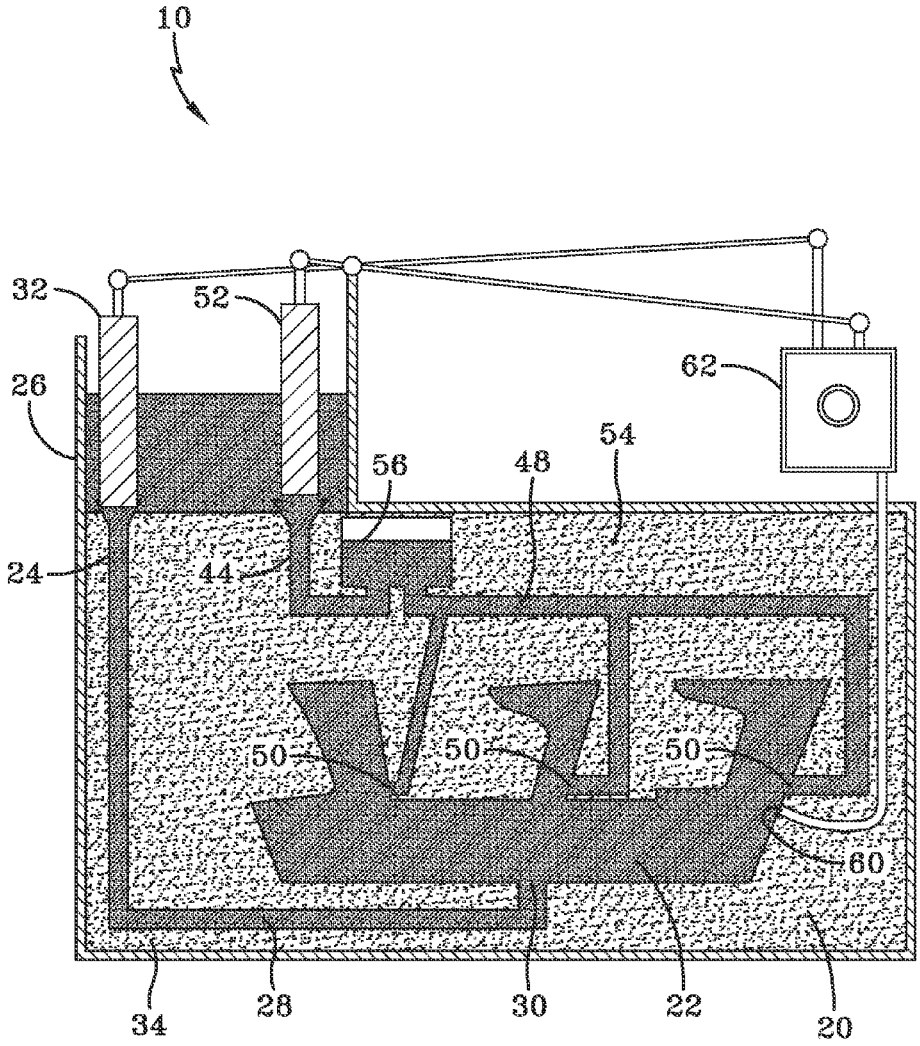
FIG. 4 is a view of FIG. 1 with the molten metal filling the mold cavity and the gating systems.

FIG. 4 shows mold cavity completely filled. Riser 56 receives the last of the hot molten metal from second sprue 44. In addition to receiving what should be the hottest molten metal, risers are also designed and placed in mold 10 so that they include the last molten metal to freeze. This allows riser 56 to feed shrinkage in the upper portion of mold cavity 22 as the casting solidifies. Riser 56 also acts as a dross trap, since any dross, which has a lower density than the metal, entering mold cavity 22 now has an opportunity to migrate to the top of the riser, the riser being subsequently removed from the casting. In the embodiment shown in FIGS. 1-4, this second portion of the mold includes the thin sections or also less massive cross-sections, which second portion should solidify more quickly, at least as compared to other portions of the casting. It should also be noted, since the multi-circuit system allows the mold cavity to be filled sequentially, the hottest metal being delivered to the coolest portion of the partially filled cavity, the mold system permits riser 56 to be smaller than otherwise would be needed since shrinkage in the lower portion of the casting is accommodated when second circuit 54 is activated.

Figure 5:
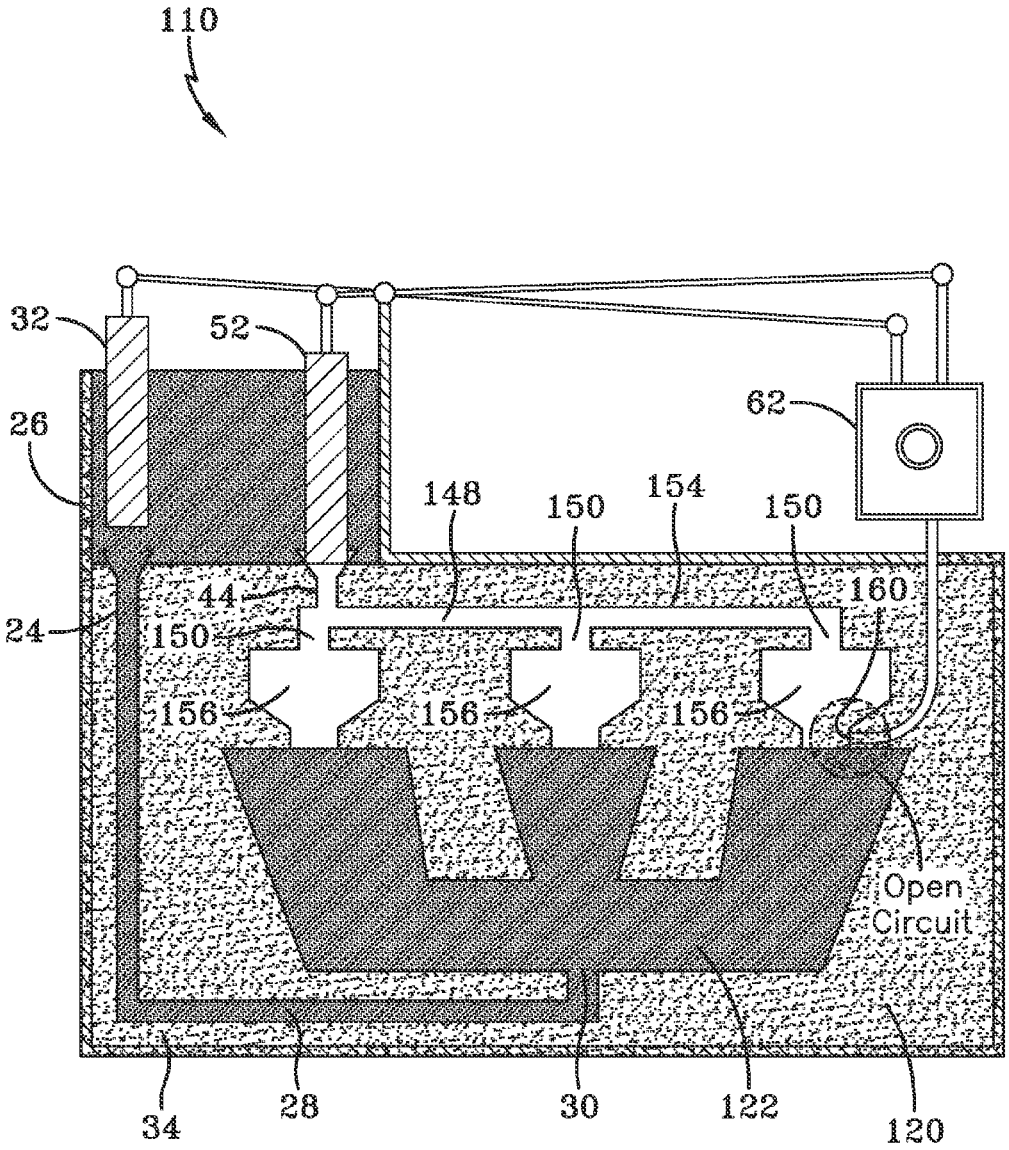
FIG. 5 is a cross-sectional view of a second embodiment of the multiple circuit mold system of the present invention with the mold cavity being filled with molten metal.

FIG. 5 depicts a second embodiment of the multi-circuit mold system 100. This second embodiment is similar to the first embodiment in that the article that is cast is a complex item, such as a turbine casing of FIG. 1, and that the mold system utilizes two circuits. However, the second embodiment utilizes a gating system that is different from the gating system utilized in the first embodiment, which will become apparent.

In the second embodiment, mold system 110 includes a mold 20 having a mold cavity 122. A first sprue 24 extends from a pouring basin or pouring cup 26. First sprue 24 provides fluid communication between pouring cup 26 and first gating system 28. First gating system provides fluid communication between first sprue 24 and mold cavity 122 through first feed or opening 30. A first stopper 32 movable in relation to first sprue 24 controls the flow of fluid, which typically is molten metal in a casting operation, from pouring cup 26 through first circuit 34, which includes first stopper 32, first sprue 24, first gating system 28 and first feed 30 into mold cavity 122.

Mold system 110 includes a second circuit 154 which comprises a second stopper 52, a second sprue 44, a second gating system 148 and a second feed 150. In second circuit 154, second stopper 52 regulates the flow of molten metal from pouring basin 26 into second sprue 44, which is in fluid communication with mold cavity 122 through second gating system 148 through second feed 150.

The bottom portion of mold system 110 includes as the mold cavity, the shape of the complex article to be cast, which in this example are turbine casings. However, the lower portion of mold cavity 122 includes both the thicker casing sections as well as the thinner casing sections. The upper portion of mold cavity 122 includes a plurality of risers 156 positioned over the lower mold cavity and in fluid communication with the lower mold cavity. Second gating system 148 feeds risers 156 through a top feed system, the feeds entering the riser cavity through a second feed 150 positioned in the top of each riser 156.

Mold system 110 further includes a sensor 160 positioned adjacent to mold cavity 22. Sensor 160 may be a simple sensor or a complex sensor as previously set forth above. Sensor 160 is in communication with controller 62, which in turn controls the operation of first and second stoppers 31, 52 respectively. The exact position of sensor 160 may be varied, and it may be positioned within riser cavity or the mold adjacent to the riser cavity, or in the lower mold or adjacent to the lower mold. Since the purpose of the second circuit 154 is to feed hot metal to the riser so that hot metal is available to feed shrinkage in the lower mold cavity as solidification occurs, it is preferable to place sensor close to the interface of the riser cavity with the lower portion of mold cavity 122.

Referring again to FIG. 5, first stopper 32 is depicted out of engagement with first sprue 24, allowing molten metal to flow through first circuit 34 to partially fill mold cavity 122. In FIG. 5, the predetermined metal level is set to be at the height of sensor 160, and the molten metal in mold cavity 122 is just below sensor 160. The predetermined metal level is always above first feed 30, and may be below, at, or slightly above the interface of riser 156 with the lower portion of mold cavity 122, and preferably is at the location where riser 156 opens into the lower mold cavity.

Figure 6:
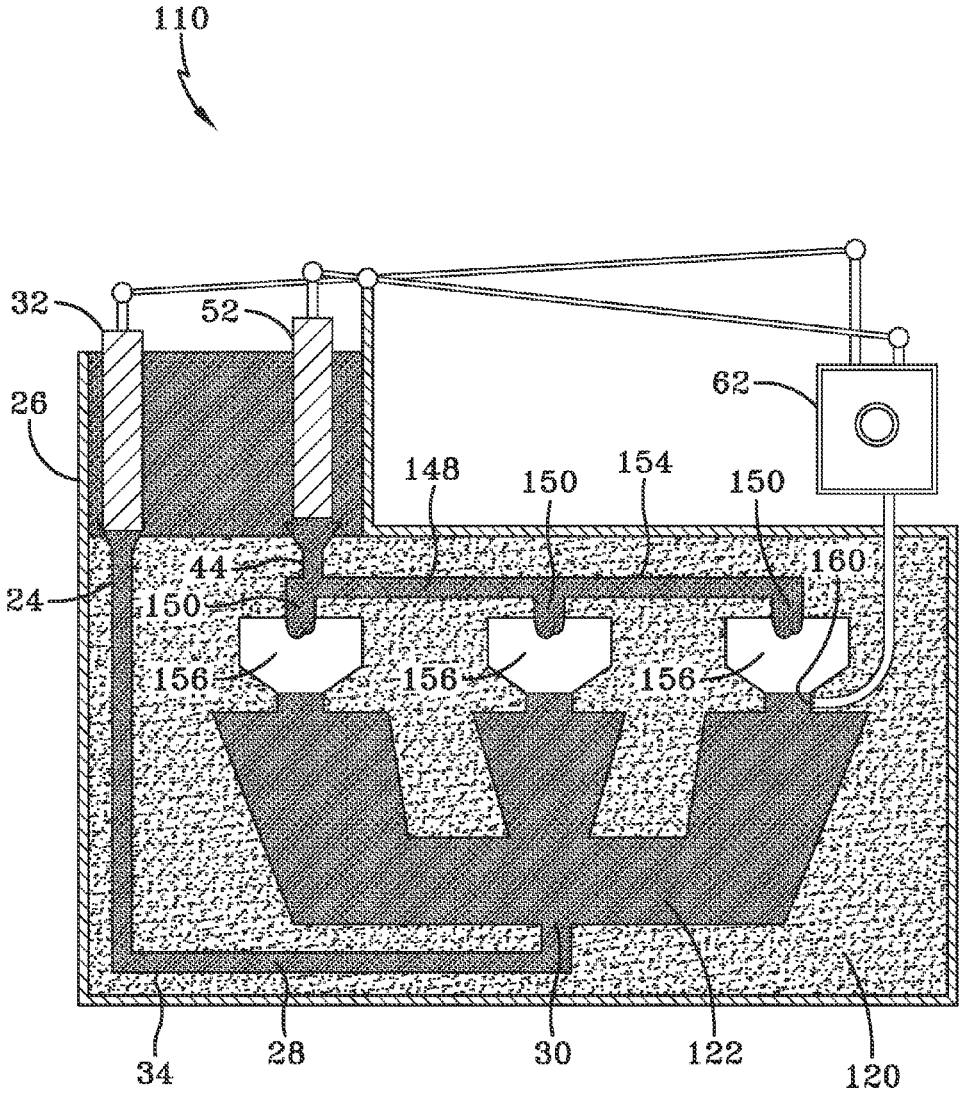
FIG. 6 a view of FIG. 5 with the molten metal filling the mold cavity to a predetermined level at which the sensor is located and molten metal initiating flow into risers.

Referring now to FIG. 6, which depicts mold cavity 122 shortly after controller causes first stopper 32 to block first sprue 24, thereby stopping the flow of molten metal into first circuit 34, and second stopper 52 unblocks second sprue 44, allowing molten metal to enter second circuit 54. As molten metal flows through second circuit 154. In FIG. 6, hot molten metal is depicted as just entering risers 156 through second feeds 150, but not flowing down through the risers to feed the lower mold cavity. However, the hot, molten metal entering risers 156 through second feeds 150 should be hotter than the metal in the lower portion of mold cavity 122.

Figure 7:
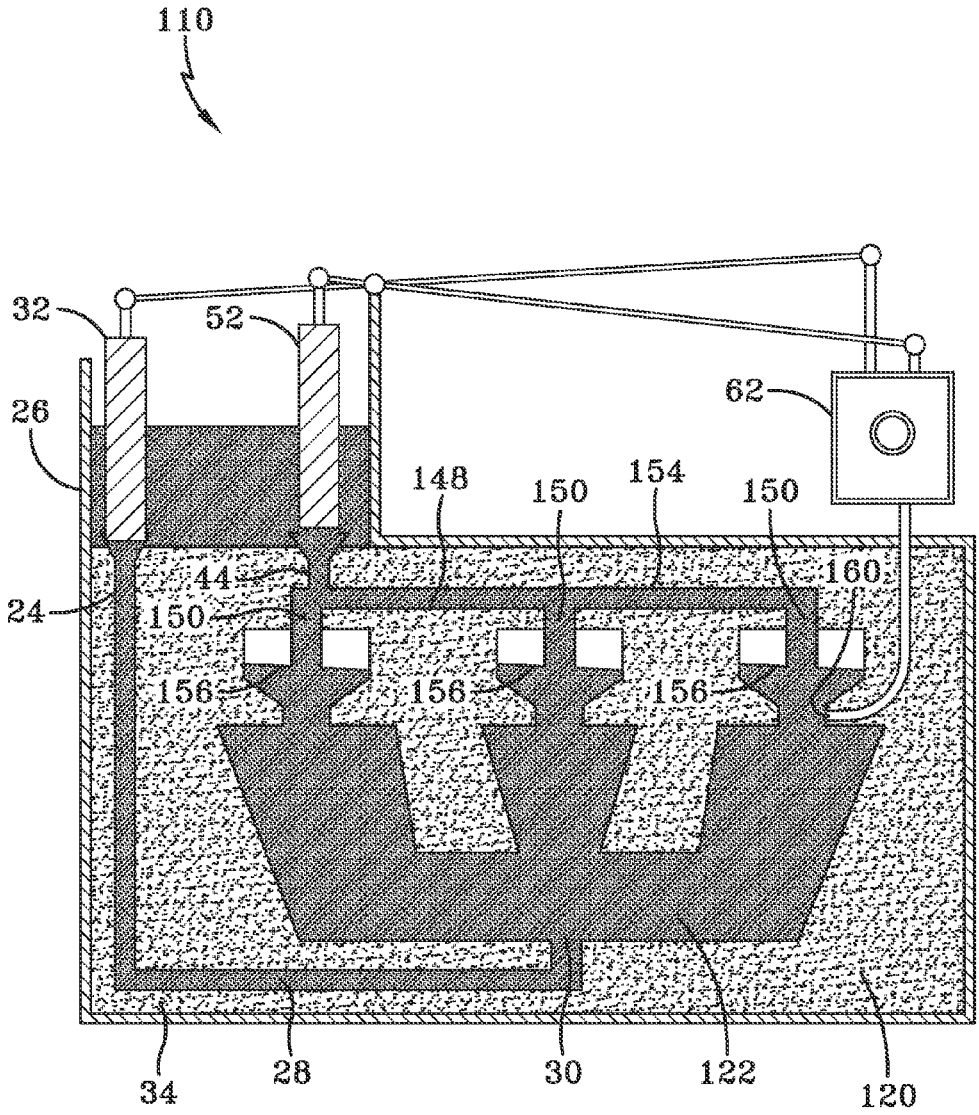
FIG. 7 is a view of FIG. 5 with molten metal filling the risers.

FIG. 7 shows the lower portion of mold cavity completely filled. Risers 156 continue to receive hot molten metal from second circuit 154. Because risers 156 are designed and placed in mold system 110 so that they include the last molten metal to freeze, risers will continue to feed the casting as it freezes, even after metal freezes in second circuit 154. As riser feeds shrinkage in the mold cavity 122 as the casting solidifies, risers 156 themselves will experience shrinkage, which is how they are designed to perform. In the embodiment shown in FIGS. 5-7, risers 156 feed shrinkage as molten metal solidifies. The hot molten metal from the risers will prevent the thinner sections on the casting from otherwise freezing rapidly. It should also be noted, since the multi-circuit system allows the mold cavity to be filled sequentially, the hottest metal being delivered to the portion of mold 120 that would otherwise freeze quickly, risers 156 may be smaller than otherwise would be needed since shrinkage in the lower portion of the casting is accommodated once second circuit 154 is activated.

Figure 8:
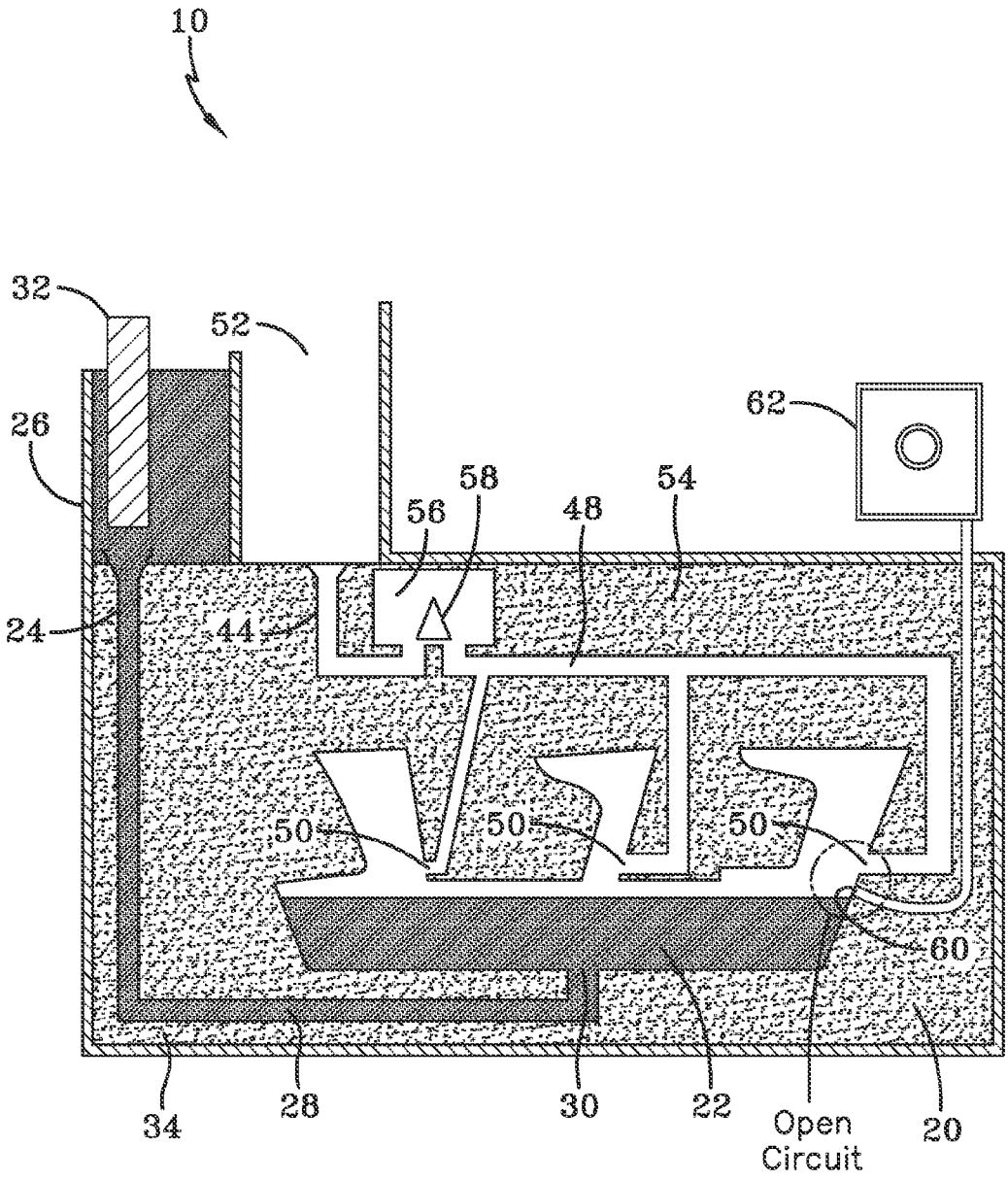
FIG. 8 depicts the multiple circuit mold system having a divided pouring cup that segregates molten metal between the first sprue and the second sprue.

The invention may be used for pouring dissimilar metal castings. For such dissimilar metal castings, two separate pouring cups 26 may be utilized, one dedicated to each of the dissimilar alloys. Alternatively, a single pouring cup with a splitter or divider 70 across the pouring cup to segregate the pouring cup into two distinct regions, one region for each alloy on pouring may be used. This arrangement is depicted in FIG. 8. Since the metal is segregated by the splitter or divider 70, the stoppers now become optional, as the metal pouring operation can control the flow of metal to the respective sprues. It is not necessary for the controller to control the flow of molten metal by use of stoppers. Rather, the controller may directly control the pouring operation, or may send a signal to indicate that pouring of a first metal should be terminated and/or that pouring of a second metal should be initiated. In addition, when pouring dissimilar metals, it is desirable to pour the alloy that solidifies at the higher temperature first, and to delay pouring the second alloy until alloy having the higher solidification temperature begins to solidify at the interface between the first and second alloys. By having such a delay, the amount of mixing of molten metal can be minimized, if not eliminated if so desired, and a strong diffusion bond between the alloys may be formed. As used herein, dissimilar metals refers to any two or more metals used in the same casting and having different chemistries and mechanical properties.

The invention set forth herein is not limited to two circuits, as any number of circuits may be designed to feed a mold cavity. Depending upon the alloy being poured, risers may be optional. In particular, riserless systems may be used for small castings. Riser systems may also be unnecessary for certain alloys such as cast irons, including ductile iron and gray iron. In these alloy systems, inoculants 58 are added to nucleate graphite and the nucleation of graphite results in volume expansion, so risers may not be required.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A mold system comprising:

a first sprue;

a second sprue;

a pouring basin arrangement for selectively feeding the first sprue and the second sprue;

a mold cavity;

a first gating system having a feed that provides fluid communication between the first sprue and a first portion of the mold cavity;

a second gating system having a feed that provides fluid communication between the second sprue and a second portion of the mold cavity, wherein the feed of the second gating system feeds the mold cavity above the feed for the first gating system;

a first stopper associated with the first sprue that regulates fluid flow through the first sprue;

a second stopper associated with the second sprue that regulates fluid flow through the second sprue;

a sensor positioned at a predetermined height of the mold cavity to determine fluid level within the mold cavity;

a controller in communication with the sensor;

wherein a signal from the sensor to the controller indicates fluid at the first predetermined height in the mold cavity indicating that the first portion of the mold cavity is filled, the controller operates the first stopper to restrict a flow of fluid through the first sprue while unblocking the second stopper from the second sprue, initiating a flow of fluid through the second sprue to allow fluid to fill the second portion of the mold cavity.

2. The mold system of claim 1 wherein the mold cavity further includes a riser positioned above the second portion of the mold cavity, the riser being in fluid communication with the second gating system and the second portion of the mold cavity.

3. The mold system of claim 1 wherein the pouring basin arrangement is a pouring basin in fluid communication with the first sprue and the second sprue.

4. The mold system of claim 3 wherein the pouring basin includes a divider separating fluid flow between the first sprue and the second sprue.

5. The mold system of claim 1 wherein the sensor is a metal specimen having a melting temperature range lower than a melting temperature range of a poured metal.

6. The mold system of claim 1 wherein the sensor is selected from the group consisting of thermistors, thermocouples and combinations thereof.

7. The mold system of claim 1 wherein the sensor is a sound detection device.

8. The mold system of claim 1 wherein the sensor is positioned in the mold cavity below the second feed.

9. The mold system of claim 1 wherein the sensor is positioned in the mold cavity at the height of the second feed.

10. The mold system of claim 6 wherein the sensor is positioned in the mold below the second feed.

11. The mold system of claim 6 wherein the sensor is positioned in the mold cavity adjacent to the second feed.

12. The mold system of claim 5 wherein the sensor is connected to a controller comprising a spring system in communication with the first and the second stopper, such that when the sensor melts, the spring system moves the first stopper in a direction that blocks the first sprue while moving the second stopper in an opposed direction that unblocks the second sprue.

13. The mold system of claim 6 wherein the controller is an electronic device in communication with the sensor and in communication with a motor, the controller sending a signal to the motor to move the first stopper into the first sprue to block the flow of fluid into the first sprue and to move the second stopper out of the second sprue to permit the flow of fluid into the second sprue when a first predetermined temperature is reached.

14. The mold system of claim 7 wherein the controller is an electronic device in communication with the sensor and in communication with a motor, the controller sending a signal to the motor to move the first stopper into the first sprue to block the flow of fluid into the first sprue and to move the second stopper out of the second sprue to permit the flow of fluid into the second sprue when a first predetermined sound level is detected.

15. A method for producing a casting comprising:

providing a mold system having a first sprue;

a second sprue;

a pouring basin arrangement for selectively feeding the first sprue and the second sprue;

a mold cavity, a first gating system having a feed that provides fluid communication between the first sprue and a first portion of the mold cavity, a second gating system having a feed that provides fluid communication between the second sprue and a second portion of the mold cavity, wherein the feed of the second gating system feeds the mold cavity above the feed for the first gating system, a first stopper associated with the first sprue that regulates fluid flow through the first sprue, a second stopper associated with the second sprue that regulates fluid flow through the second sprue, a sensor positioned at a first predetermined height of the mold cavity, and a controller in communication with the sensor;

providing molten metal:

pouring molten metal into the pouring basin arrangement;

removing the first stopper from the first sprue so that molten metal flows through the first gating system into the mold cavity:

monitoring the height of molten metal in the mold cavity, the sensor determining when the molten metal reaches the predetermined first height;

signaling the controller that the molten metal is at the predetermined first height; and wherein when the controller is signaled that the molten metal is at a predetermined first height, the controller acts to restrict the flow of metal into the first sprue with the first stopper while withdrawing the second stopper from the second sprue to permit the flow of metal into the second sprue, allowing molten metal to flow through the second gating system and into the second portion of the mold cavity.

16. The method of claim 15 wherein the step of providing a mold system having a pouring basin arrangement that segregates molten metal flow between the first sprue and the second sprue.

17. A method for producing a casting comprising:

providing a mold system having a first sprue;

a second sprue;

a pouring basin arrangement for selectively feeding the first sprue and the second sprue while segregating flow between the first sprue and the second sprue;

a mold cavity, a first gating system having a feed that provides fluid communication between the first sprue and a first portion of the mold cavity, a second gating system having a feed that provides fluid communication between the second sprue and a second portion of the mold cavity, wherein the feed of the second gating system feeds the mold cavity above the feed for the first gating system, a sensor positioned at a first predetermined height of the mold cavity, and a controller in communication with the sensor;

providing molten metal:

pouring molten metal into the pouring basin arrangement;

removing a first stopper from the first sprue so that molten metal flows through the first gating system into the mold cavity:

monitoring the level of molten metal in the mold cavity so that when the sensor determines that the molten metal is at the predetermined height, the determination is communicated to the controller;

wherein when the controller is signaled that the molten metal is at the predetermined height, the controller acts to restrict the flow of metal into the first sprue by moving the first stopper into the first sprue while withdrawing a second stopper from the second sprue to initiate the flow of metal into the second sprue, allowing molten metal to flow through the second gating system and into the second portion of the mold cavity.

18. The method of claim 17 wherein the step of providing a mold system having a pouring basin arrangement segregating metal flow includes providing a pouring basin having a divider between the first sprue and the second sprue.

19. The method of claim 17 wherein the step of providing a mold system having a pouring basin arrangement segregating molten metal flow includes providing a first pouring basin for feeding the first sprue and a second pouring basin for feeding the second sprue.

20. The method of claim 17 wherein the steps of providing a molten metal and pouring the molten metal into the pouring basin arrangement further includes providing a first molten metal having a first composition and a first melting temperature range and selectively feeding the first sprue and first gating system, and then providing a second molten metal having a second composition and a second melting range temperature and selectively feeding the second sprue and the second gating system, thereby providing a casting comprising dissimilar metals.

21. A mold system comprising:

a first sprue;

a second sprue;

one pouring basin, the pouring basin arranged arrangement for selectively feeding the first sprue and the second sprue while segregating flow between the first sprue and the second sprue;

a mold cavity;

a first gating system having a feed that provides fluid communication between the first sprue and a first portion of the mold cavity;

a second gating system having a feed that provides fluid communication between the second sprue and a second portion of the mold cavity, wherein the feed of the second gating system feeds the mold cavity above the feed for the first gating system;

a sensor positioned at a predetermined height of the mold cavity to determine fluid level within the cavity;

a controller in communication with the sensor;

wherein when the sensor senses fluid at the predetermined height, the controller blocks the first sprue, halting a flow of fluid through the first gating system to the first portion of the mold cavity while unblocking the second sprue, initiating a flow of fluid to the second gating system to allow fluid to fill the second portion of the mold cavity.

* * * * *